US005911612A

United States Patent [19]

Steger

[11] Patent Number: 5,911,612

[45] Date of Patent: Jun. 15, 1999

[54] FOLDABLE, INFLATABLE FLOTATION DEVICE WITH IMPROVED RETENTION MEANS

[75] Inventor: Ralph E. Steger, Baxley, Ga.

[73] Assignee: ERO Industries, Inc., Mt. Prospect, Ill.

[21] Appl. No.: 08/929,181

[22] Filed: Sep. 8, 1997

[51] Int. Cl.[6] ..... B63H 9/125

[52] U.S. Cl. ..... 441/118; 441/116

[58] Field of Search ..... 441/106, 114–119, 441/121

[56] References Cited

U.S. PATENT DOCUMENTS

| | | | |
|---|---|---|---|
| 1,442,746 | 1/1923 | Timberlake . | |
| 1,623,993 | 4/1927 | Anderson . | |
| 1,833,614 | 11/1931 | Matuskey . | |
| 2,326,987 | 8/1943 | Weinheimer . | |
| 2,807,035 | 9/1957 | Phillips . | |
| 3,441,964 | 5/1969 | Koch et al. | 441/118 |
| 3,761,982 | 10/1973 | Hawkins | 441/118 |
| 4,662,850 | 5/1987 | Bostic, Sr. . | |
| 4,689,030 | 8/1987 | McWaters . | |
| 4,820,221 | 4/1989 | Aubrey . | |
| 5,370,566 | 12/1994 | Mitchell, Jr. et al. . | |
| 5,456,623 | 10/1995 | Norris . | |
| 5,466,179 | 11/1995 | Jeffrey, Sr. . | |

FOREIGN PATENT DOCUMENTS

| | | | |
|---|---|---|---|
| 2 223 987 | 4/1990 | United Kingdom | 441/118 |

OTHER PUBLICATIONS

Dacor Corporation Chameleon Advertisement from Skin Diver.

Kent Sporting Goods Company, Inc. "Air–N–Float".

*Primary Examiner*—Sherman Basinger

*Attorney, Agent, or Firm*—Vedder Price Kaufman & Kammholz

[57] ABSTRACT

A personal flotation device in the form of a vest having two chest portions that are interconnected by a neck portion. The vest fits over a user's head and is secured to the user by way of a belt and a chest strap. The vest is inflatable by the user and in a deflated condition, the chest portions are folded upon themselves to present a low profile vest that may be worn by the user without interfering in marine activities. A plurality of frangible fasteners are disposed on flap portions of the chest portions to retain the chest portions in their folded condition, yet release the flap portions under inflation pressure.

15 Claims, 4 Drawing Sheets

FOLDABLE, INFLATABLE FLOTATION DEVICE WITH IMPROVED RETENTION MEANS

BACKGROUND OF THE INVENTION

The present invention relates generally to inflatable flotation devices, and more particularly to a foldable inflatable flotation device that may be worn in its folded, uninflated condition and inflated while worn.

Flotation devices are well known. They may take the form of life jackets, life vests or floating cushions. The availability of these devices is mandatory in boating. United States Coast Guard regulations require that each person on a boat have a flotation device available for his or her use. Standard flotation devices, such as life jackets are cumbersome to wear and store when not in use.

In an attempt to overcome this cumbersome aspect, certain inflatable flotation devices have been developed that are self-inflatable by the user. One such device is described in U.S. Pat. No. 5,466,179 issued Nov. 14, 1995. This device has one or more inflatable bladders attached to a belt. The inflatable bladders are folded and contained in a pouch. This device contains a waist band that retains the pouch on a user's waist. Although this device is not cumbersome, it does not locate the flotation portions of the device on the wearer in a position to ensure a safe orientation of the wearer in the water. This and other flotation devices are complicated for the wearer to understand and operate. These devices must be properly put on by the user to ensure that they will operate in a safe manner and act as a personal flotation device for the user.

One known inflatable vest that has a reduced profile on its wearer is the "Air-n-Float" life vest produced by Kent Sporting Goods of New London, Ohio. Although this life vest has two foldable chest portions interconnected by a neck portion, it requires the use of an interconnected waist and back strap to hold it on its wearer. The two chest portions are foldable upon each other but are connected only to the waist strap. As a result, the two chest portions may spread apart from each other when the vest is worn, resulting in it slipping over the user's head, thereby severely compromising the vest's ability to stay on the wearer.

The present invention is directed to a low profile, inflatable life vest that has improved retention characteristics to retain the vest on its wearer, whether inflated or not.

Accordingly, a need exists for an inflatable flotation device that is not cumbersome, is retained in place around the user's neck and chest and is self inflatable.

It is therefore an object of the present invention to provide an inflatable flotation device that may be worn by a user during water activities without unduly encumbering the user and which may be easily inflated by the user.

Another object of the present invention is to provide an inflatable, personal flotation device in the form of a vest that extends around the neck and over the chest of its wearer, the vest having two distinct chest portions with fastening means applied thereto, the chest portions being foldable upon each other when the vest is in a deflated condition and the chest portions being secured in a folded condition by the fastening means and wherein the chest portions are secured in place on the user beneath the head of the user.

Yet still another object of the present invention is to provide an inflatable flotation device that is worn like a vest by its user, the device having an internal, inflatable bladder that is enclosed by an outer fabric cover, the cover and bladder cooperatively defining three distinct portions of the device: a neck portion and two chest portions that are interconnected together by the neck portion, the fabric cover and bladder being further cooperatively foldable upon themselves and the chest portions having a width sufficient to permit them to define flaps thereof that are foldable upon each other, the chest and neck portions further cooperatively defining a vest with a reduced profile on its wearer, the vest further having means for inflating the bladder, the vest being secured to itself in such a manner that when inflated, the vest unfolds upon the wearer, and the vest having a strap interconnecting the two chest portions together beneath the head of the wearer in a position that ensures that the vest will remain in place on the wearer whether the vest is inflated or not.

SUMMARY OF THE INVENTION

In one principal aspect of the present invention, a flotation device in the form of an inflatable vest is provided that is worn about the neck and chest of a user. The vest has an internal, inflatable bladder that has three portions: one portion hangs over one side of the user's chest, a second portion of the bladder hangs over the other side of the user's chest, while a third portion interconnects the two chest portions. The bladder is enclosed within a durable outer covering. The vest is secured by a user to his body by way of a waist strap that holds the vest securely on the user. A chest strap is provided to secure the two chest portions together underneath the user's head and in proximity to the user's chin.

In another principal aspect of the present invention, at least the chest portions of the flotation device are foldable upon themselves. In order to facilitate the folding of the vest, the chest and neck portions have a plurality of fasteners disposed thereon in positions that retain the vest in a folded condition. The chest portions have flap portions on which the fasteners are located and the chest portions are interconnected by the chest strap from the underside of the device. A means for inflating the vest, such as a compressed gas cartridge and triggering assembly, is interconnected to the internal bladder and is mounted on one of the vest portions. When triggered by way of a rip cord extending out from one of the chest portions, the gas cartridge inflates the vest on the user. The force of the inflation causes the vest's folded portions to unfold and inflate.

The position of the chest and waist straps ensure that the vest, when inflated and deflated, always lies in its proper location on the chest of the user. Importantly, this location prevents the vest from coming off of the user and maintains the user in an upright position when in the water. The foldable nature of the vest permits its user to easily put it on by slipping it over his head and placing the belt around his waist. The chest and waist buckles are closed and the waist belt is adjusted to a snug fit. The rip cord is positioned in a location easily accessible to the user, between the folds of the vest. The folds of the vest are positioned so that the expanding gas from the cartridge, when triggered, unfolds the vest under the force of gas inflation.

With the present invention, the flotation device can be worn without presenting any interference to its wearer. Additionally, the manner of donning the flotation device is readily understood and easily accomplished by any wearer, regardless of age.

These and other features and objects of the present invention will become apparent from a reading of the following detailed description in which the preferred embodiment of the invention is explained, taken in conjunction with the accompanying drawings in which like reference numerals refer to like parts.

BRIEF DESCRIPTION OF THE DRAWINGS

In the course of the following detailed description, reference will be frequently made to the accompanying drawings in which.

DETAILED DESCRIPTION OF THE PREFERRED EMBODIMENT

Figure 1:
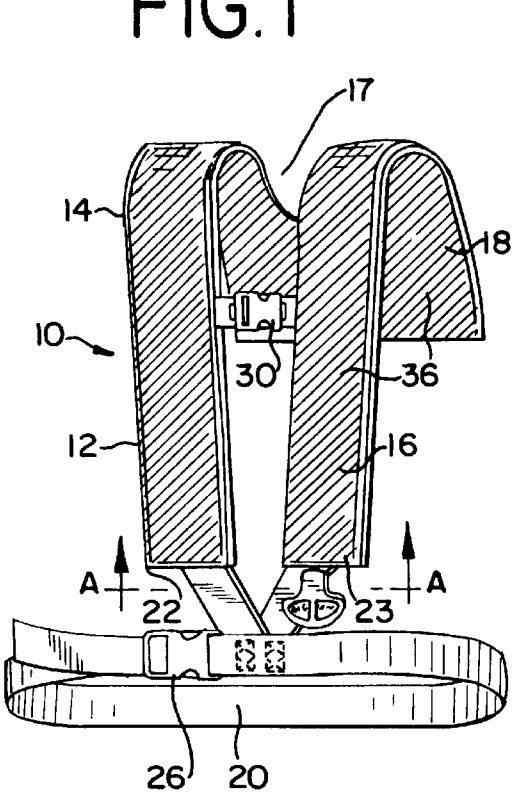
FIG. 1 is a perspective view of an inflatable flotation device constructed in accordance with the principles of the present invention.

FIG. 1 illustrates a preferred embodiment of an inflatable flotation device 10 constructed in accordance with the principles of the present invention. The device 10 takes the form of an inflatable vest 12 having a pair of vertical portions 14, 16 that extend vertically over a user's chest and a horizontal neck portion 18 that fits around the neck of a user and interconnects the two chest portions 14, 16 together. A waist belt, or strap, 20 that interconnects the chest portions together is positioned at and preferably attached to the lower ends 22, 23 of the chest portions opposite the neck portion 18. The waist belt 20 includes an adjustable buckle assembly 26 by which a user may adjust the strap 20 and the overall position of the vest 12.

Figure 7:
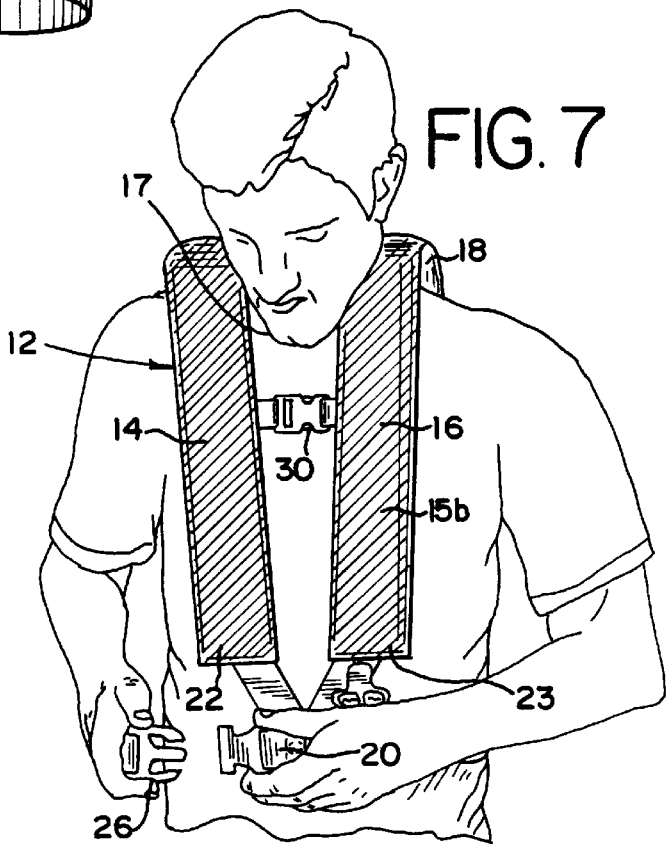
FIG. 7 is a frontal view of a user donning the flotation device of the present invention.

FIG. 7 illustrates a user donning the vest 12. As shown, the vest neck portion 18 lies behind the user's neck, while the two chest portions 14, 16 extend over the user's chest on opposite sides of the user's head. The chest and neck portions 14, 16 & 18 cooperatively define an inner, or neck, opening 17 through which the user's head and neck projects. The waist strap 20 is positioned in alignment with and beneath the two chest portions 14, 16 so that it may be easily manipulated by the user. Importantly, a second strap assembly 30 is provided to interconnect the two chest portions 14, 16 together in a location between the neck portion 18 and the waist strap 20 above the user's chest in proximity to the user's head. The second strap assembly 30 lies intermediate the neck opening 17 and the waist strap 20 and preferably is positioned closer to the neck opening 17 than the waist strap 20 so that when buckled, the second strap assembly 30 may engage the chin of the user. As such, this chest strap assembly 30 advantageously secures the vest 12 upon the chest of the user, and when the vest is inflated, the chest strap 30 will prevent the user's head from slipping out through the head opening 17.

Figure 2:
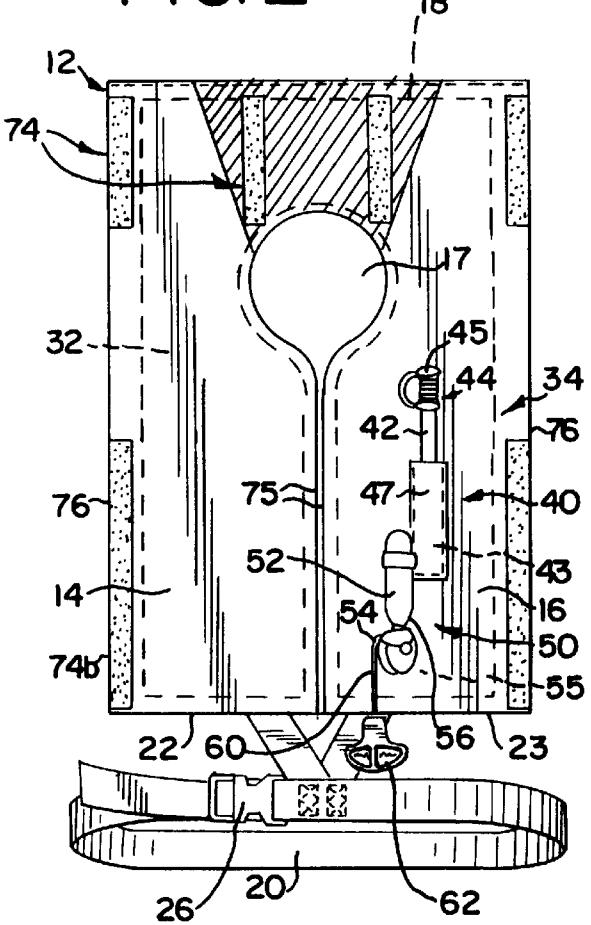
FIG. 2 is a frontal view of the flotation device of FIG. 1 in an expanded, open condition illustrating some of the fastening strips that hold the chest portions of the flotation device together when the vest is folded.
Figure 9:
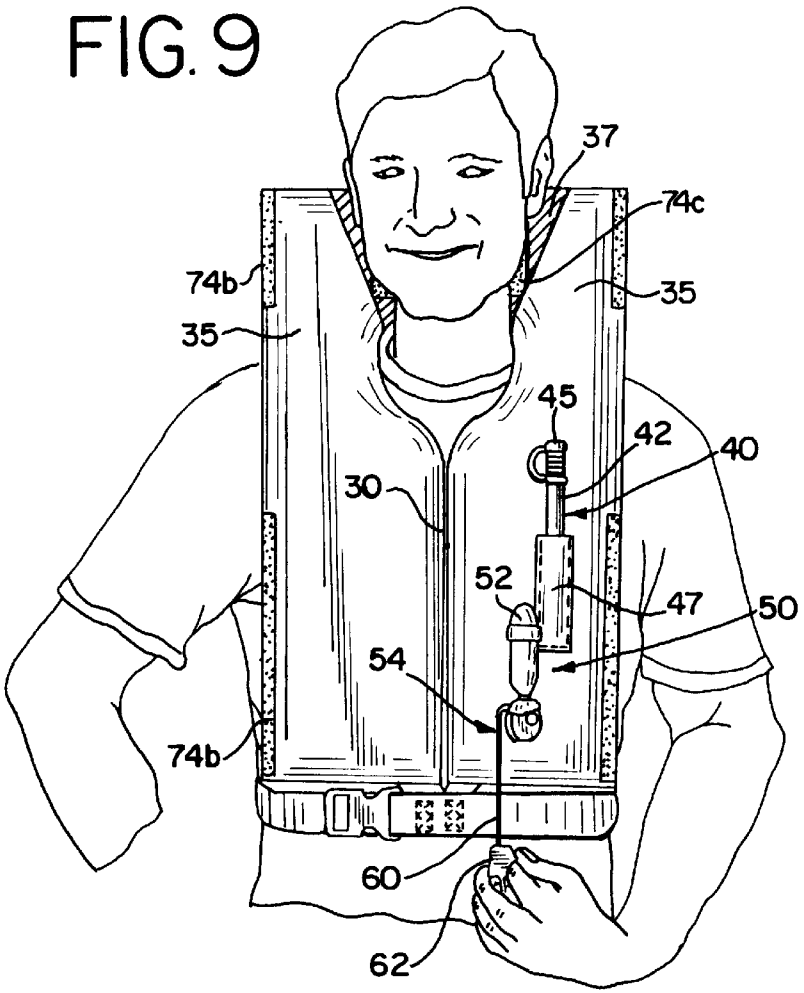
FIG. 9 is the same view as FIG. 8, but with the flotation device inflatable on the user; and, FIG. 10 is a bottom end view of the flotation device of FIG. 1, taken along lines A–A thereof and illustrating the opening of the flaps of the chest portions of the device when inflated.
Figure 8:
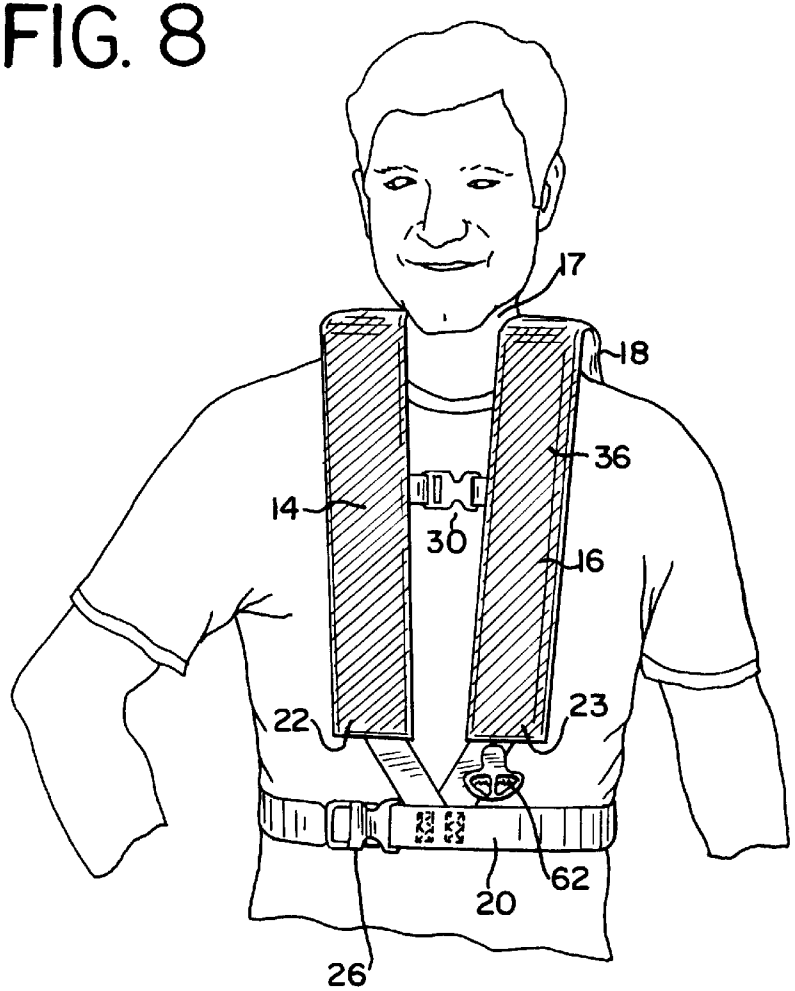
FIG. 8 is a frontal view of the flotation device of FIG. 7 in place on a user and secured thereto.

The vest 12 has a conventional internal construction. That is, as shown in phantom in FIG. 2, it contains a hollow internal flexible inflation bladder 32 that is contained within the vest 12 by a durable outer fabric cover 34. The cover 34 is typically formed from a plurality of fabric panels 35, 36, with the panels 35, 36 being respectively positioned on the front and rear surfaces of the vest 12, when the device 100 is in an inflated condition as shown in FIG. 9. In order to provide a visual contrast between the chest portions 14, 16, an additional fabric panel 37 may be interposed between the front panels 35 that cover the front of the chest portions 14, 16. In the preferred embodiment, the fabric panels 35 are of a very bright color, such as yellow, while the other panels 36 and additional panel 37 are of a darker color, such as blue. The brighter fabric panels 35 are preferably used to form the cover of the two chest portions 14, 16.

The device 10 includes means 40 for inflating the internal inflation bladder 32. This inflation means 40 is illustrated best in FIGS. 2 & 3 and firstly includes a manual, oral inflation tube 42 that is connected at one end 43 thereof to the inflation bladder 32. The other end 44 of the manual inflator tube 42 extends along and over the vest 12 upon one of the chest portions 16 into proximity of the user's mouth. (FIG. 9.) The inflator tube 42 may include a conventional check valve (not shown) and a cap 45 that covers the inflation end 44 of the tube 42. The check valve permits the oral inflator tube 42 to be used to deflate the vest in a conventional manner. A portion of the length of the inflator tube 42 may be retained in a pocket 47 formed on one of the front fabric panels 35 of the vest 12. A user need only blow into the open end 44 of the inflation tube 42 to inflate the vest bladder 32.

Secondly, the inflation means also advantageously includes a power inflator 50 which includes a gas cartridge 52 and a triggering mechanism 54. The power inflator 50 is connected at one end 55 thereof to the inflation bladder 32 and the other end 56 thereof is positioned externally of the vest 12. This other end 56 contains a port (not shown) which receives an insertion end 58 of the gas cartridge 52. The triggering mechanism 54 includes a conventional firing pin (not shown) that is actuated by the user pulling a ripcord 60. The ripcord 60 extends lengthwise along the front panel 35 of one of the chest portions 16 and preferably past the end 23 of the chest portion 16. The rip cord 60 may, as shown, have a trigger member 62 attached to its end to facilitate the user's gripping thereof. The trigger member 62 also extends past the end 23 of the chest portion 16.

The vest 12 can be folded into a compact condition when deflated, such as shown in FIGS. 1 and 4–7 so it may be easily worn by a user without being cumbersome to the user. In order to complement this foldable aspect and to retain the vest 12 in a folded condition (FIG. 4), the chest portions 14, 16 are sufficiently wide to define one or more flap portions 15 thereof. One or more frangible fastening means 70 are provided. As shown best in FIG. 3, these fastening means 70 are disposed on two opposing surfaces of the vest 12 and on the two fabric panels 35, 36 thereof. In the preferred embodiment, these fastening means 70 are located primarily on the front and rear surfaces of the chest portions 14, 16.

The fastening means may take the form of any suitable fastener that will retain the flaps 15 of the chest portion together when deflated and will release the flaps under the pressure of the inflation means, either oral inflation or powered inflation. A preferred fastener comprises multiple strips 72 of easily engageable material, such as hook and loop fastening material commonly sold under the trademark "VELCRO". The fastener strips 74 are utilized to retain the chest portion flaps 15 in their folded condition when the vest 12 is deflated.

In this regard, the strips 74 are aligned with the outer and inner edges 75, 76 of the chest portions 14, 16 of the vest 12. Some of the strips 74*a* are positioned on the rear panels 36 of the chest portions 14, 16, while other strips 74*b*, 74*c* are positioned on the front panels 35. The positioning of these fastening strips 74 permits the chest portions 14, 16 to be folded upon itself around an imaginary centerline C of each chest portion 14, 16 so that the chest portions 14, 16, when folded, present a substantially flat and narrow profile as compared to flotation devices of the prior art that rely upon kapok, foam or the like for flotation. The width of the chest portions is sufficiently wide so that two flaps 15 may be made in each chest portion. The chest strap assembly 30 preferably extends between the two flaps 15 and as illustrated, it is attached to the rear panels 36 of the chest portions 14, 16 of the vest and preferably in conjunction with the fastening strips 74*a* in order to reinforce its attachment to the vest 12. With this manner of attachment, the chest strap 30, in effect, appears to be attached to the front side of the chest portions 14, 16 when the vest 12 is in a folded, deflated condition on the user. This unique positioning improves the ability of the chest strap 30 and particularly the buckle thereof to contact the chin of the user and prevent the vest 12 from sliding over the head of the user.

It can be seen that when the vest 12 is deflated and folded, the folding reduces the width of chest portions 14, 16 down to a substantially flat and narrow profile that will not interfere with the user, such as happens with a kapok or foam-filled life vest. The location of the fastening strips 74*a–c* along opposing edges of the chest portions facilitates the folding of the vest 12 and accentuates the extent to which the vest may be reduced in size when uninflated and worn by a user.

Figure 3:
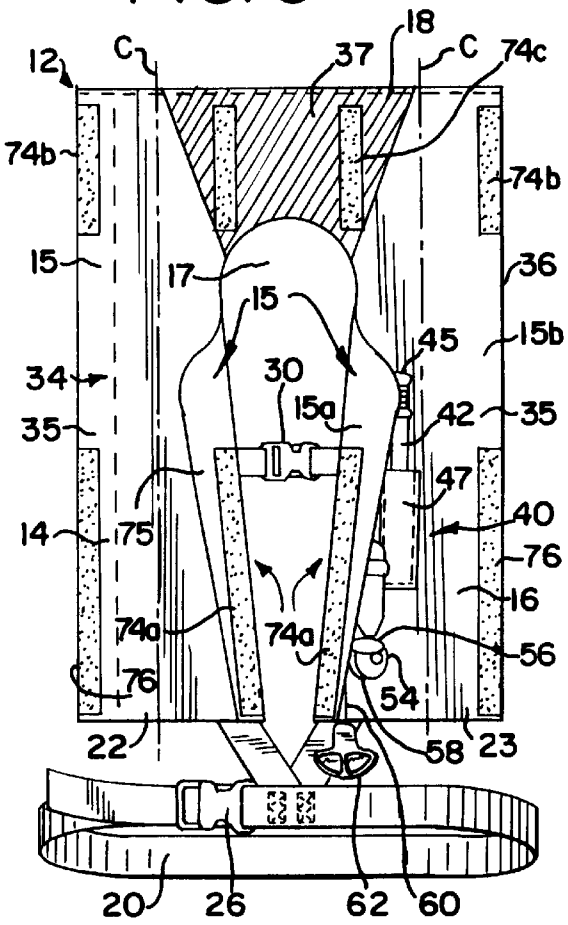
FIG. 3 is the same view of FIG. 2 with the inner flaps of the chest portions of the flotation device folded forward to expose the chest strap and interior fastening strips.
Figure 4:
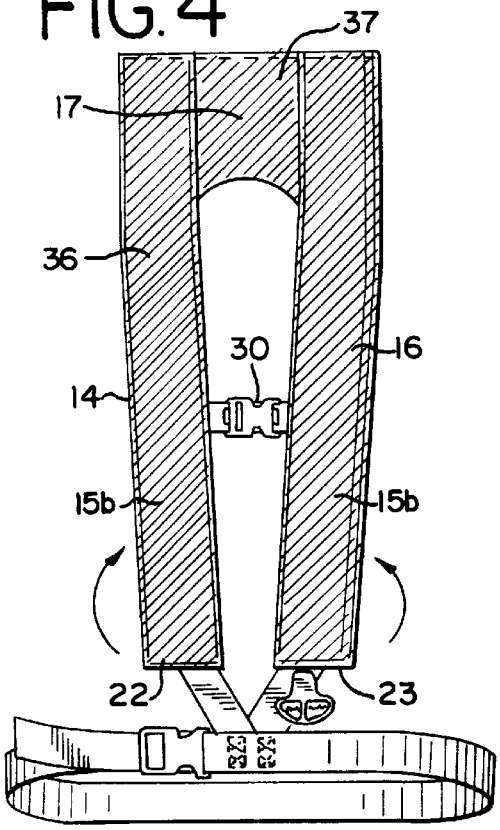
FIG. 4 is a frontal view of the flotation device with the chest portion flaps folded together and over each other.

In folding the deflated device 10, a user may first grasp the interior flaps 15*a* by the inner edges 75 of the chest portions 14, 16 as shown in FIG. 3, and fold them over slightly in order to expose their associated inner fastening strips 74*a*. Next, as illustrated in FIG. 4, the user may then fold the exterior flaps 15*b* by the outer edges 76 of the chest portions 14, 16 upon the interior flaps 15*a* and toward the inner edges 75 of the chest portions 14, 16 so that the outer edges 76 will preferably mate with the inner edges 75 thereof. In this alignment, the pairs of fastening strips 74*b* will be aligned and will engage their counterpart strips 74*a*, 74*c*. The fastening strips 74 will then hold the vest 12 in its folded condition as illustrated in FIG. 4. In this condition the vest 12 is easily worn by a user while boating and because the vest 12 is uninflated, it will not act as a cumbersome piece of apparel that would interfere with the user's boating activities.

Figure 5:
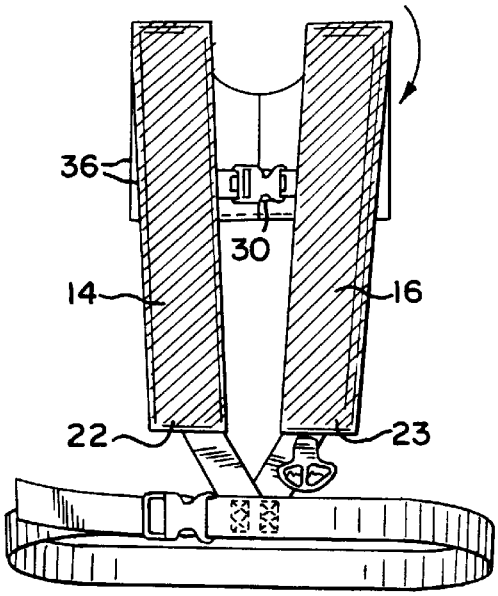
FIG. 5 is the same view as FIG. 4, but with the neck portion folded behind and beneath the chest portions.
Figure 6:
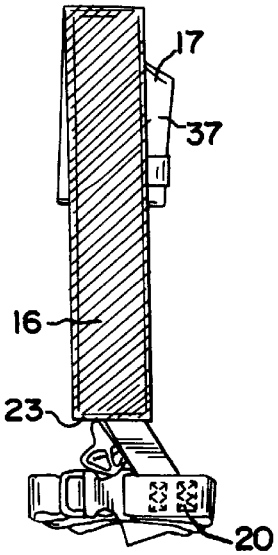
FIG. 6 is the same view as FIG. 5 but with the two chest portions folded together upon each other.

The vest 12 may be further folded to reduce its size. The neck portion 18 may be folded behind the chest portions 14, 16 as shown in FIG. 5, and then the two chest portions 14, 16 may be folded upon each other as shown in FIG. 6 to capture the neck portion 17 therebetween. The waist belt 20 may also be folded upon itself as shown in FIG. 6 and the entire assembly may be bound together with another fastener, such as a rubber band (not shown).

Figure 10:
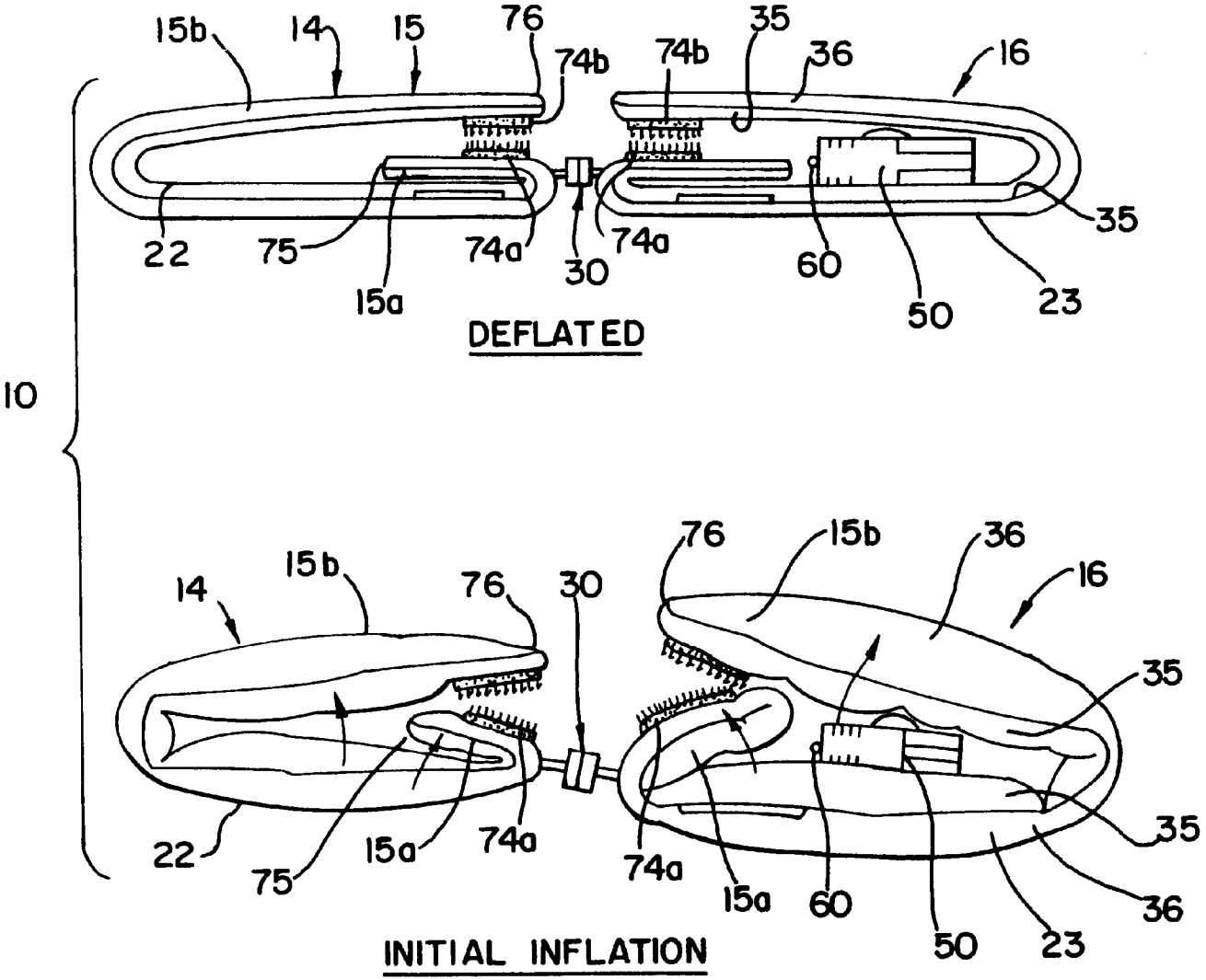

Importantly, when deflated and folded, both the oral inflator tube 42 and the power inflator 50 lie between the flap portions 15*a, b*. (FIG. 10.) The top end 44 of the oral inflator tube 42 lies underneath the exterior flap 15*b* of the chest portion 16 in the area between the fastening strips 74 where it is accessible by a user. The vest ripcord 60 and its trigger member 62 extend past the end 23 of the one chest portion 16 so that the user may access it quickly should the need to inflate the vest 12 arise. Because of the frangible nature of the fastening strips 74, they are easily disengaged under minimum force, the power of the gas from the cartridge entering the inflation bladder 32 will initially cause the chest portion flaps 15*a*, 15*b* to unfold. Continued expansion of the gas (or air supplied orally by a user) into the inflation bladder 32 will achieving complete inflation of the device 10 to the expanded profile shown in FIG. 9.

This unfolding causes the fastening strips 74*a–c* to disengage. (FIG. 10.) The chest strap 30, because of its location, will keep the vest 12 from sliding off of the user by preventing the two chest portions 14, 16 from spreading apart, while the inflatable neck portion 18 and the chest portions 14, 16 of the vest 12 will tend to keep the user's head out of the water. The chest strap 30 also further eliminates the need for a backstrap as used in the prior art to interconnect the neck portion of the vest with the waist straps, thereby increasing the comfort level of the user.

The present invention provides benefits over the prior art flotation devices. The present invention may be worn in an uninflated condition without interfering with the user's abilities to operate a boat or other marine craft. The folding of the vest is accomplished in a manner by which the folds are easily opened under inflation pressure. It can be seen that the flotation device of the present invention can be worn without presenting any interference to its wearer. Additionally, the manner of donning the flotation device is readily understood and easily accomplished by any wearer, regardless of age.

While the preferred embodiment of the invention has been shown and described, it will be apparent to those skilled in the art that changes and modifications may be made therein without departing from the spirit of the invention, the scope of which is defined by the appended claims.

What is claimed is:

1. A personal flotation device, comprising: an inflatable vest portion adapted to be placed about the neck of a user; a waist belt for securing the vest portion in place on the user, the vest portion including an inflatable bladder and a cover enclosing the bladder, said vest portion further including two distinct chest portions and a neck portion interconnecting the two chest portions at first ends thereof, the belt portion interconnecting said two chest portions at second ends thereof, said two chest portions being sufficiently wide to define at least two flap portions thereof which may be folded upon themselves about respective imaginary centerlines of said chest portions when said device is deflated; means operable by said user for inflating said bladder; means for frangibly retaining said chest portions flaps in a folded condition when said inflatable bladder is deflated and permitting said chest portion flaps to unfold when said inflatable bladder is inflated; a chest strap extending between said two chest portions intermediate of said chest portions first and second ends; each of said two chest portions including distinct front and rear surfaces and said frangible retaining means including a plurality of fastening strips, each of said front and rear surfaces of said chest portions including at least one fastening strip, and said chest strap being attached to said two chest portions on the rear surfaces thereof; a neck opening interposed between said two chest portions that is partially defined by said chest strap, the neck opening receiving the neck of said user when said device is worn by said user, said neck opening further being disposed between said chest strap and said neck portion; said chest strap further being disposed on said device intermediate said neck opening and said waist strap and proximate to said neck opening so that when connected, said chest strap prevents the head of a user from slipping out through said neck opening.

2. The personal flotation device as claimed in claim 1, wherein said first and second ends of said chest portions are opposite ends.

3. The personal flotation device as claimed in claim 1, wherein said frangible retaining means include a plurality of fastening strips disposed on surfaces of said chest portions.

4. The personal flotation device as claimed in claim 3, wherein said fastening strips include strips of hook and loop fastening material.

5. The personal flotation device as claimed in claim 1, wherein said chest portions include inner and outer edges, and said fastening strips are disposed thereon proximate to said chest portion inner and outer edges.

6. The personal flotation device as claimed in claim 1, wherein said inflatable bladder extends through said neck and two chest portions.

7. The personal flotation device as claimed in claim 1, wherein said inflation means is disposed on a surface of one of said chest portions and is substantially contained between said chest portion flaps when said device is deflated, and said inflation means includes a power inflator, the power inflator including a gas cartridge, a gas cartridge firing mechanism communicating with said inflatable bladder and receiving said gas cartridge, said firing mechanism also including a triggering mechanism for firing said gas cartridge, the triggering mechanism including a trigger member that extends past one of said chest portion second ends for access by said user.

8. The personal flotation device as claimed in claim 1, wherein said inflation means is disposed on a surface of one of said chest portions and is substantially contained between said chest portion flaps when said device is deflated, and said inflation means includes an oral inflator in communication with said inflatable bladder, said oral inflator being mounted on a surface of one of said chest portions, said oral inflator being accessible by said user whether said vest is inflated or deflated.

9. The personal flotation device as claimed in claim 1, wherein said frangible retaining means include a plurality of fastening strips proximate to opposing edges of said chest portion flaps and said chest strap being disposed in proximity to at least a pair of said fastening strips.

10. The personal flotation device as claimed in claim 1, wherein said inflation means includes an oral inflator and a power inflator, the oral and power inflators being disposed on a single surface of one of said chest portions, said oral and power inflators being substantially contained between said chest portion flaps when said device is deflated yet said oral and power inflators being accessible by said user when said vest is deflated and said chest portion flaps folded upon themselves.

11. An inflatable flotation device, comprising an inflatable vest adapted to be worn on the neck of a user, the vest having a generally inverted U-shape, said vest further having a neck portion and two chest portions that depend from the neck portion, the neck portion being disposed behind the user's head when the device is worn, said neck portion interconnecting the chest portions at a location behind said user's head, said chest portions extending partially over a portion of the chest of said user when said device is worn, a dual belt assembly connected to said chest portions for securing said vest to said user, the dual belt assembly including a first belt adapted to be secured around the waist of said user and interconnecting two free ends of said chest portions, and a second belt adapted to be positioned over the chest of said user and interconnecting said chest portions together in proximity to the chin of said user, an inflator assembly for use by said user to inflate said vest for flotation purposes, said vest having an expanded profile when inflated and a substantially flat profile when deflated, said inflator assembly being disposed on one of said chest portions, each of said chest portions having a width sufficient to define at least two flap portions thereof which are foldable upon said chest portions when said device is deflated, means for frangibly fastening said chest portion flaps in a folded condition when said device is deflated, but releasing said chest portion flaps when said device is inflated; each of said chest portions including respective inner and outer edges, and said means for frangibly fastening said chest portion flaps including a plurality of elongated fastener strips, some of the fastener strips being disposed proximate to said chest portion inner edges and others of said fastener strips being disposed proximate to said chest portion outer edges, said second belt being attached to said client portions in proximity to said chin of said user so as to prevent the head of a user of said device from slipping out of said rest.

12. The inflatable flotation device as claimed in claim 11, wherein said inflator assembly includes an oral inflator and a power inflator, each of the oral and power inflators communicating with an interior portion of said vest, said oral and power inflators being disposed on one of said two chest portion of said vest, said oral and power inflators being contained between said flap portions of said one chest portion when said vest is deflated and said flap portions are fastened to each other.

13. The inflatable flotation device as claimed in claim 12, wherein said power inflator includes a gas cartridge, a gas cartridge firing mechanism that receives said gas cartridge, the firing mechanism also including a triggering mechanism for firing said gas cartridge, the triggering mechanism including a trigger member that extends past an end of said one chest portion for access by said user.

14. The inflatable flotation device as claimed in claim 11, wherein said frangible fastening means includes a plurality of hook and loop fasteners.

15. An inflatable flotation vest adapted to be worn around the neck of a user and having improved retention characteristics, the vest comprising: a neck portion that sits behind the neck of a user when worn and two chest portions that extend over the chest of a user when worn, the vest having an inflation assembly for inflating said vest, said vest having an expanded profile when inflated and a substantially flat and narrow profile when deflated, the vest having flap portions associated with said chest portions that may be folded thereupon when said vest is deflated to form the substantially flat and narrow profile when worn by the user without interfering in physical movement of said user, the neck and chest portions cooperating to define a neck opening of said vest that accommodates said user's neck when worn, said vest further including a plurality of frangible fasteners disposed on said flap portions that retain said vest flap portions in said substantially flat and narrow profile when said vest is deflated, but release the flap portions and permit expansion of said vest under inflation pressure of said inflation assembly, and a plurality of strap for securing said vest to said user, including a first connectable strap having two connectable ends that extend around the waist of said user and a second connectable strap having two connectable ends that extend over the chest of said user, said first connectable strap interconnecting said chest portions at ends thereof opposite said neck portion and said second connectable strap being spaced apart from said first strap toward the head of said user and from said neck opening to interconnect said chest portions together proximate to said user's head, said second connectable strap being spaced further apart from said first connectable strap than from said neck opening, whereby when said second connectable strap ends are connected together, said second connectable strap is maintained in a location that reduces said neck opening to a size that prevents said vest from sliding over said user's head.

* * * * *